US007800543B2

(12) United States Patent
Humphrey

(10) Patent No.: US 7,800,543 B2
(45) Date of Patent: Sep. 21, 2010

(54) FEED-POINT TUNED WIDE BAND ANTENNA

(75) Inventor: Denver Humphrey, Ballymena (GB)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/320,970

(22) Filed: Feb. 10, 2009

(65) Prior Publication Data

US 2009/0243940 A1 Oct. 1, 2009

Related U.S. Application Data

(63) Continuation-in-part of application No. 12/078,440, filed on Mar. 31, 2008, now Pat. No. 7,742,001.

(51) Int. Cl.
*H01Q 1/38* (2006.01)

(52) U.S. Cl. ..... 343/700 MS; 343/873

(58) Field of Classification Search ..... 343/700 MS, 343/873, 702, 846

See application file for complete search history.

(56) References Cited

U.S. PATENT DOCUMENTS

| | | | | |
|---|---|---|---|---|
| 5,828,340 | A | 10/1998 | Johnson | |
| 5,929,825 | A * | 7/1999 | Niu et al. | 343/895 |
| 6,300,909 | B1 * | 10/2001 | Tsubaki et al. | 343/700 MS |
| 6,693,594 | B2 * | 2/2004 | Pankinaho et al. | 343/700 MS |
| 6,803,881 | B2 * | 10/2004 | Ishihara et al. | 343/700 MS |
| 6,891,507 | B2 | 5/2005 | Kushihi et al. | |
| 7,019,698 | B2 | 3/2006 | Miyoshi et al. | |
| 7,081,859 | B2 | 7/2006 | Miyoshi et al. | |
| 7,136,020 | B2 | 11/2006 | Yamaki | |
| 7,196,663 | B2 | 3/2007 | Bolzer et al. | |
| 2003/0201943 | A1 * | 10/2003 | Kadambi et al. | 343/702 |
| 2004/0012530 | A1 | 1/2004 | Chen | |
| 2007/0222699 | A1 | 9/2007 | Modro | |
| 2009/0243937 | A1 * | 10/2009 | Humphrey et al. | 343/700 MS |
| 2009/0243940 | A1 | 10/2009 | Humphrey | |

FOREIGN PATENT DOCUMENTS

| | | |
|---|---|---|
| EP | 0 762 533 A2 | 3/1997 |
| JP | A-2005-203817 | 7/2005 |
| WO | WO 2006/022350 A1 | 3/2006 |

OTHER PUBLICATIONS

Office Action issued by the U.S. Patent and Trademark Office in U.S. Appl. No. 12/078,440 on Dec. 30, 2009.

European Search Report issued in European Patent Application No. 09 00 4702 on Jul. 10, 2009.

* cited by examiner

*Primary Examiner*—Tho G Phan
(74) *Attorney, Agent, or Firm*—Oliff & Berridge, PLC

(57) ABSTRACT

A wideband chip antenna which is capable of receiving and transmitting signals from an ultra wideband system, where the ultra wideband system comprising a plurality of band groups, and where the response of the antenna can be tuned at the design stage so that a zero in the response of the antenna falls so that its peak is at a particular given frequency, and so that the zero occurs inside an unwanted band group of the ultra wideband system.

24 Claims, 10 Drawing Sheets

| Band Group | Band | Frequency Range |
|---|---|---|
| Band Group #1 | #1 | 3168 - 3696 MHz |
| | #2 | 3696 - 4224 MHz |
| | #3 | 4224 - 4752 MHz |
| Band Group #2 | #4 | 4752 - 5280 MHz |
| | #5 | 5280 - 5808 MHz |
| | #6 | 5804 - 6336 MHz |
| Band Group #3 | #7 | 6336 - 6864 MHz |
| | #8 | 6864 - 7392 MHz |
| | #9 | 7392 - 7920 MHz |
| Band Group #4 | #10 | 7920 - 8448 MHz |
| | #11 | 8448 - 8976 MHz |
| | #12 | 8976 - 9504 MHz |
| Band Group #5 | #13 | 9504 - 10032 MHz |
| | #14 | 10032 - 10560 MHz |

FEED-POINT TUNED WIDE BAND ANTENNA

This is a Continuation-in-Part of application Ser. No. 12/078,440 filed Mar. 31, 2008. The disclosure of the prior application is hereby incorporated by reference herein in its entirety.

FIELD OF THE INVENTION

The present invention relates to wide band antennas, particularly, but not exclusively, for use in Ultra Wideband (UWB) systems, or systems defined by the IEEE 802.15 family of standards. The invention is particularly concerned with antennas that are suitable for integration into portable handsets for wireless communications and other wireless terminals.

BACKGROUND TO THE INVENTION

Existing 2G and 3G cellular systems such as Global System for Mobile Communications (GSM) and Universal Mobile Telephone System (UMTS) operate over a frequency band which is relatively narrow compared to the frequency of operation—for example, the UMTS system has an operating band extending from 1920 to 2170 MHz. The design of antennas offering good performance with bandwidths for one or more 2G or 3G systems is relatively well established.

Future wireless networks will be required to provide much higher data transfer rates than existing systems, and as a result the required operating bands will generally become wider. The UWB systems defined by the WiMedia Alliance and the IEEE 802.15.3 standards describe systems with operating bands ranging from 3.2 to 10.6 GHz. At the same time, the future evolution of wireless handsets and terminals will see an increased functionality and the capability to operate on multiple systems, so that the physical dimensions of the constituent parts of each system will become necessarily smaller. For such future systems, a new type of antenna design becomes an imperative: an antenna which retains the small physical dimensions of antennas for 2G and 3G systems while offering good performance over a bandwidth extending over several GHz.

Wideband planar antennas are well known; for example, U.S. Pat. No. 5,828,340, Johnson, describes a planar antenna having a 40% operational bandwidth, where the extended bandwidth is achieved by forming a tab antenna on a substrate where the tab antenna has a trapezoidal shape. Furthermore, it is known that the physical dimensions of an antenna can be reduced by fabricating the antenna on a substrate with a high dielectric constant, such as Alumina. U.S. Pat. No. 7,019,698, Miyoshi, describes a gap-fed chip antenna comprising a radiating portion formed by the union of a reversed triangular portion and a semicircular portion sandwiched between two dielectric layers and comprising a feeding portion which couples to the radiating portion. The antenna taught by Miyoshi is suitable for use as an antenna device operating according to the UWB system and has dimensions in the order of one quarter of one wavelength at an operating frequency of 6 GHz. A similar antenna is described in U.S. Pat. No. 7,081,859, Miyoshi et al.

FIG. 1 shows a prior art monopole chip antenna comprising a dielectric chip 10, arranged on an insulating carrier substrate 15. The antenna includes a radiating structure 11 fabricated on an obverse face of dielectric chip 10, a feed point, realized by a metal input/output (I/O) pad 12 fabricated on carrier substrate 15, and a corresponding device terminal fabricated on a reverse face of dielectric chip 10. A metal connecting trace 16A connects I/O pad 12 to radiating element 11. Carrier substrate 15 includes a feed line 17 which connects a transceiver device (not shown) to metal I/O pad 12.

Despite the advances taught in Johnson and Miyoshi, for integration in mobile wireless handsets and terminals, antennas with further reduced physical dimensions are highly desirable. Moreover a solution to the problem of producing a highly miniaturized ultra wideband antenna with excellent performance characteristics (e.g. a return loss of less than −6 dB and a high radiation efficiency over a frequency range from 3.2 to 10.6 GHz) has, so far, yet to be found.

Accordingly, it would be desirable to provide a wideband chip antenna fabricated on a dielectric substrate, which is suitable for integration in a portable wireless handset or terminal, where the bandwidth of the antenna extends over an ultra wide band frequency range, e.g. from 3.2-10.6 GHz, and where the antenna has dimensions which are small compared with the wavelength of the lower edge of the operating frequency band of the antenna.

FIG. 11 shows the band groups of the UWB system as defined by the WiMedia Alliance. It can be seen that frequency range extends from 3.2 GHz to 10.6 GHz.

It is widely accepted in industry that any service offering data transfer using by the UWB system will not use UWB band group 2, since sections of UWB band group 2 have already been allocated to the 802.11a system. It is acceptable therefore for the antenna to exhibit a poor response over the frequency range of the 802.11a because this eases the specifications for RF filters required to block 802.11a signals from the UWB front-end. Accordingly, it would be desirable to provide an antenna wherein the frequency response can be tuned to take advantage of system characteristics such as that described above.

SUMMARY OF THE INVENTION

From a first aspect, the invention provides an antenna comprising a first radiating structure located substantially in a first plane; a second radiating structure electrically connected to said first radiating structure and located substantially in a second plane, said first plane being spaced apart from and substantially parallel to said second plane; a feed point located substantially in said second plane and substantially in register with a first end of said first radiating structure, said feed point being electrically connected to said first radiating structure; a block of dielectric material located substantially between said first radiating structure and second radiating structure and said feed point to provide a spacing between said first and second planes; and a stub comprising a length of transmission line having a first end electrically connected to said feed point and a second free end, said stub being located substantially in said second plane and extending in a direction from said feed point towards a second end of said first radiating structure, said second end being opposite said first end of said first radiating structure.

In preferred embodiments, a feed pad is provided at said feed point, said stub being connected to said feed pad. Typically, said feed pad is located substantially in register with said first end of said first radiating structure. More particularly, said feed pad may be positioned such that an edge of said feed pad is substantially in register with an edge of said first radiating structure, and typically also with an edge of said block of dielectric material, said stub being connected to and extending from an opposite edge of said feed pad.

In typical embodiments, the antenna has a frequency response that includes a pass band, in which signals may be transmitted and/or received during use, and an attenuation band, in which said signals are relatively attenuated, occurring within said pass band, the arrangement being such that said attenuation band is centred about a frequency that is determined by the length of said stub. Hence, during the design of the antenna, the length of said stub may be selected to centre the attenuation band at a frequency where relatively poor antenna performance is acceptable.

In preferred embodiments, said first frequency band is the ultra wide band (UWB) as defined by the WiMedia Alliance, and said second frequency band is UWB band group 2.

Preferably, said stub extends substantially parallel to a central axis of said first radiating structure. More preferably, said stub is substantially in register with said central axis.

From a second aspect, the invention provides an antenna comprising a first radiating structure located substantially in a first plane and having a feed point located substantially at a first end of said radiating structure; a second radiating structure located substantially in a second plane, said first plane being spaced apart from and substantially parallel to said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first ends of said at least two radiating elements being substantially in register with said second end of said first radiating structure.

Preferably, said first radiating structure is provided on an obverse face of said dielectric block, and said second radiating structure is provided on a reverse face of said dielectric block. Alternatively, at least one of said first and second radiating structures is embedded in said dielectric block.

In preferred embodiments, said at least two radiating elements are substantially parallely disposed with respect to one another. Preferably, said at least two radiating elements extend substantially parallely with a central axis of said first radiating structure, said central axis passing through said first and second ends of the first radiating structure.

In some embodiments, said at least two radiating elements extend from their respective first end in a direction substantially towards said first end of said first radiating structure.

Alternatively, said at least two radiating elements extend from their respective first end in a direction substantially away from said first end of said first radiating structure.

Optionally, said second radiating structure comprises a centre radiating element extending substantially perpendicularly between said at least two radiating elements. Preferably, said centre radiating element is located substantially in register with said second end of said first radiating structure.

Preferably, said at least two radiating elements are substantially symmetrically arranged about a central axis running between said first and second ends of said first radiating structure.

In preferred embodiments, said first radiating structure comprises a substantially planar patch of electrically conductive material.

Typically, said first and second radiating structures are electrically connected by at least two spaced apart electrically conductive connectors, e.g. conductive vias or conductive traces, wherein a respective electrically conductive connector connects each of said at least two radiating elements to said first radiating structure. Advantageously, said respective electrically conductive connectors are located substantially at said respective first end of said at least two radiating elements.

A third aspect of the invention provides an antenna device comprising a substrate formed from an electrically insulating material; an antenna mounted on said substrate, said antenna comprising a first radiating structure located substantially in a first plane and having a feed point located substantially at a first end of said radiating structure; a second radiating structure located substantially in a second plane, said first plane being spaced apart from and substantially parallel to said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first end of said at least two radiating elements being substantially in register with said second end of said first radiating structure.

In preferred embodiments, said antenna is mounted on said substrate such that said second radiating structure is located substantially on an obverse face of said substrate.

Advantageously, a respective electrically conductive contact pad is provided on said obverse face of said substrate for each of said at least two radiating elements, the respective contact pad being substantially in register with and in contact with the respective radiating element. Preferably, an electrically conductive input/output contact pad is provided on said obverse face of said substrate, the electrically conductive input/output contact pad being substantially in register with and connected to said feed point.

Optionally, a ground plane is provided on said obverse face of the substrate, spaced apart from said antenna. In preferred embodiments, said ground plane comprises first and second adjacent portions spaced apart to define a gap therebetween, and wherein a signal feeding structure passes through said gap.

In a particularly preferred form, the antenna is a two-tier wideband antenna comprising a chip of a dielectric material with an upper radiating structure and a lower radiating structure, the dielectric chip being mounted on an insulating carrier substrate which includes a feed-line to connect the antenna to a transceiver device. The lower radiating structure comprises two elements which have a large aspect ratio so as to reduce the frequency of the lower band edge of the antenna when compared with a monopole patch antenna fabricated on a similar dielectric chip. The antenna of the present invention is suitable for operation over an ultra wideband, e.g. a frequency range extending from 3.2 to 10.6 GHz.

Antennas embodying the invention are advantageously compact, surface mountable, operable over a wide frequency range and suitable for integration in portable handsets for wireless communications and other wireless terminals. The antennas have a relatively wide operating band and can be adapted for use in systems including but not limited to Ultra Wideband (UWB) or those defined by the IEEE 802.15 family of standards.

Advantageously, antennas embodying the first aspect of the invention are capable of receiving and transmitting signals from an ultra wideband system, where the ultra wideband system comprises a plurality of band groups, and where the response of the antenna can be tuned at the design stage so that a zero in the response of the antenna falls so that its peak is at a particular given frequency, and so that the zero occurs inside an unwanted band group of the ultra wideband system.

Preferred embodiments of said first aspect of the invention comprise an ultra-wideband antenna comprising a chip of a dielectric material, the dielectric chip including a reverse face and an obverse face, said obverse and reverse faces being substantially parallel to each other. The antenna is mounted on a carrier substrate so that said reverse face of said dielectric chip is flush with said carrier substrate. An upper radiating structure is disposed on said obverse face of said dielectric chip and a second radiating structure is disposed on said reverse face of said dielectric chip. The insulating carrier substrate includes an electrically conducting feed-line which connects said antenna to a transceiver device, and also includes a ground plane. The dielectric chip further comprises a plurality of faces, substantially perpendicular to said reverse face and said obverse face of said dielectric chip, one of said faces, the adjacent face, being nearest to said ground plane on said carrier substrate, but being offset by a given distance. The upper and second radiating structures are electrically connected, for example by metallic strips fabricated on one of said perpendicular faces of said dielectric chip. The feed-line connects at one end to an I/O terminal of said antenna fabricated on the reverse face of said dielectric chip; said I/O terminal being located near said adjacent face of said dielectric chip. Electrical connection between said I/O terminal and said upper element of said antenna is achieved by, for example, a metal filled, or lined, through hole which penetrates said dielectric chip. The antenna is suitable for operation over an ultra wideband, e.g. a frequency range extending from 3.2 to 10.6 GHz where said ultra wideband is divided into a plurality of separate band groups. A tuning stub is fabricated on the reverse face of said dielectric chip, electrically connecting to said I/O terminal and extending in a direction away from the feed point of the antenna, and in particular from a feed pad located at said feed point, by a distance X. In the design of said antenna, the distance X is carefully selected so that a zero in the response of said antenna attenuates one of said plurality of separate band groups.

It will be understood that structures that are described herein as "radiating structures" radiate electromagnetic energy only during use, i.e. when excited by an appropriate electrical signal. Similarly, the term "radiating structures" used herein refers to structures which can be used to receive a signal when an electromagnetic wave is incident on thereon.

BRIEF DESCRIPTION OF THE DRAWINGS

Embodiments of the invention are now described by way of example and with reference to the accompanying drawings in which like numerals are used to denote like parts and in which.

DETAILED DESCRIPTION OF THE DRAWINGS

Figure 2:
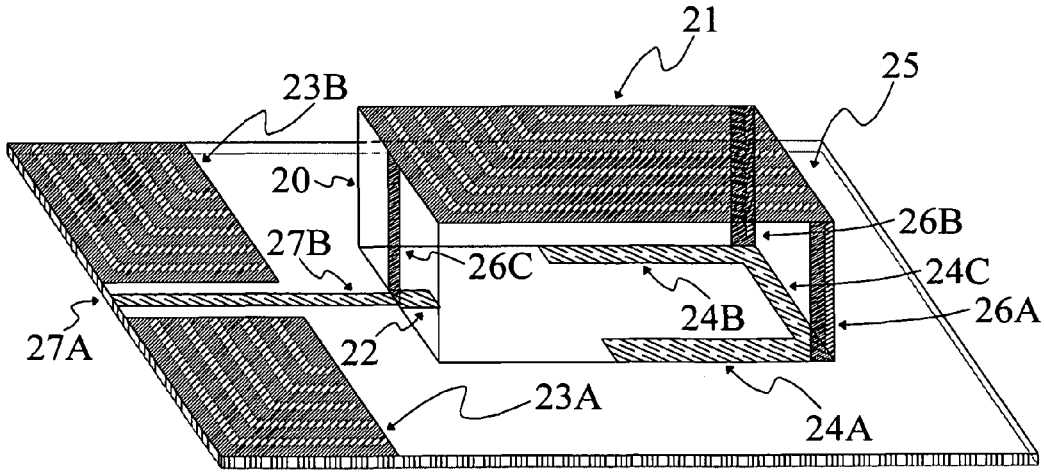
FIG. 2 is a perspective view of a two-tier chip antenna mounted on a substrate and embodying said second and third aspects of the present invention.

FIG. 2 shows a two-tier wideband chip antenna embodying said second aspect of the present invention. The antenna of FIG. 2 comprises a block, or chip, 20 of a material with a dielectric constant which is greater than unity. Dielectric chip 20 is mounted in use on an insulating carrier substrate 25 which includes ground planes 23A, 23B, preferably disposed on the obverse face of insulating carrier substrate 25. Dielectric chip 20 is positioned on carrier substrate 25 so as to be offset from ground planes 23A, 23B. The chip 20 may be secured to the substrate 25 by any suitable means, e.g. solder.

Dielectric chip 20 has an obverse face on which a first, or upper, radiating structure 21 is provided, and a reverse face which is substantially flush with the obverse face of carrier substrate 25. The radiating structure 21, which is formed from any suitable electrically conductive material and is typically metallic, takes the preferred form of a planar, or patch, radiating element. In preferred embodiments, the planar radiating element 21 covers substantially the entire surface of the obverse face of the chip 20. Typically, the chip 20 is substantially rectangular in transverse and longitudinal cross-section. The radiating element 21 is typically substantially rectangular in shape.

The antenna has a feed point 22 which is preferably located on a reverse face of dielectric chip 20 and substantially in register with a first end of the upper radiating element 21, typically substantially at the midpoint of the first end. In the embodiment of FIG. 2, the feed point 22 is located on the lower surface and near an edge of dielectric chip 20 which is realized by a metal I/O pad 22 disposed on the lower surface of dielectric chip 20. I/O pad 22, is electrically connected to upper radiating element 21 by an electrical connector in the form of a conducting metal trace 26C.

A second, or lower, radiating structure is provided on the reverse face of the chip 20. The lower radiating structure comprises three radiating elements namely spaced apart, elongate side elements 24A and 24B, and centre element 24C which joins side elements 24A, 24B together. Lower radiating side elements 24A and 24B are electrically connected to upper radiating element 21 by conducting metal trace lines 26A and 26B respectively. The trace lines 26A, 26B may be located on a respective side face of the block 20, or on the end face, as is convenient. It will be seen that the upper radiating element 21 and the lower radiating elements 24A, 24B, 24C are spaced apart from one another by the chip 20, the trace lines 26A, 26B providing the only interconnection. Preferably, the arrangement is such that the upper radiating element 21 and the lower radiating elements 24A, 24B, 24C are disposed in respective substantially parallel planes.

In preferred embodiments, each side element 24A, 24B has a respective first end, the respective first ends being substantially in register with each other and with a second end of the first radiating element 21, in particular, the end of the first radiating element 21 that is distal the feed point 22. Conveniently, the side elements 24A, 24B are each connected to said first radiating element at their respective first end, the respective connection being between the respective first end of the side element 24A, 24B and the end of the radiating element 21. This may be seen by way of example from FIG. 2 wherein the trace lines 26A and 26B are located substantially at the ends of the respective radiating elements 21, 24A, 24B. It is also preferred that the centre element 24C extends between the respective first ends of the side elements 24A, 24B. The side elements 24A, 24B are preferably substantially parallel to one another. Each side element 24A, 24B advantageously runs substantially parallel to, and preferably still substantially in register with, a respective edge of the upper radiating element 21. The centre element 24C preferably runs substantially perpendicular to the side elements 24A, 24B. In preferred embodiments, the centre element 24C extends substantially in register with and substantially parallel to the end of the upper radiating element 21.

In the embodiment of FIG. 2, each side element 24A, 24B extends from its first end in a direction towards the first end of the first radiating element 21, i.e. generally towards the feed point 22. Hence, the side elements 24A, 24B run substantially beneath the upper radiating element 21. The side elements 24A, 24B, which may be substantially the same length, may be dimensioned to extend wholly or partly along the length of the chip 20. The length of the side elements 24A, 24B from their first end to their free end may be less than, greater than, or substantially equal to the end-to-end length of the upper radiating element 21. Advantageously, the side elements 24A, 24B are arranged substantially symmetrically about a central axis that runs from one end of the first radiating element 21 to the other, typically the longitudinal axis of the radiating element 21. In preferred embodiments, the feed point 22 is located substantially on, or at least substantially in register with said central axis.

Electrical connection between the antenna and a transceiver device (not shown) is made by a feed-line, which has two sections 27A and 27B. Section 27A of the feed-line is preferably a coplanar waveguide structure bounded on both sides by ground planes 23A and 23B; section 27B of the feed-line extends between and connects co-planar waveguide feed-line section 27A and I/O pad 22. Alternative options for section 27A of the feed line include, a microstrip line, a grounded coplanar waveguide, a coaxial line, or a stripline.

The offset of dielectric chip 20 from ground planes 23A and 23B is selected for optimum performance of the antenna; typically this offset is less than the longitudinal dimension of dielectric chip 20. Ground planes 23A and 23B may alternatively be realized by a single ground plane which may be arranged on the upper surface of carrier substrate 25, or on the lower surface thereof. Alternatively one or more ground planes may be arranged on some other remotely located substrate (not shown).

In FIG. 2, upper radiating element 21 is shown so that it covers the entire obverse face of dielectric chip 20; however, upper radiating element 21 may be arranged so that it only partially covers the obverse face of dielectric chip 20. In particular, upper radiating element 21 may be arranged so that it tapers away from ground planes 23A and 23B, as the distance from metal trace line 26C increases.

In FIG. 2, upper radiating element 21 and lower radiating elements 24A, 24B and 24C are shown on the obverse and reverse faces of dielectric chip 20. This arrangement is suitable when the antenna is fabricated from a dielectric chip. An alternative arrangement has the upper radiating element embedded inside dielectric chip 20 and near the obverse face thereof. Similarly, lower radiating elements 24A, 24B and 24C may be embedded near the reverse face of dielectric chip 20.

Figure 3:
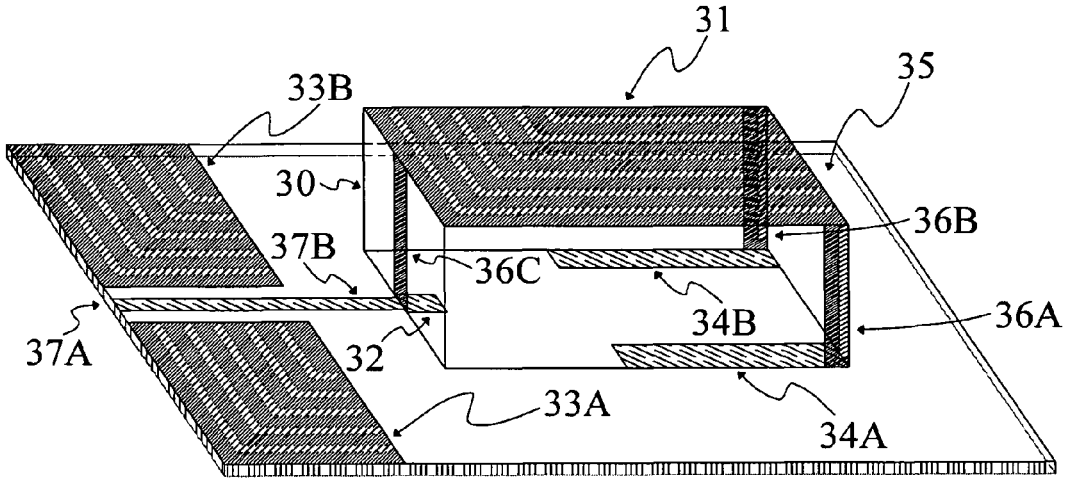
FIG. 3 is a perspective view of an alternative two-tier chip antenna mounted on a substrate and embodying said second and third aspects of the present invention.

FIG. 3 shows an alternative two-tier wideband chip antenna embodying said second aspect of the invention. In this embodiment, the centre element between side elements of the lower radiating structure is omitted. Otherwise, the antenna of FIG. 3 is substantially similar to the antenna of FIG. 2 and the same description applies as would be understood by a skilled person. The antenna of FIG. 3 comprises a chip 30 of a material with a dielectric constant which is greater than unity. Dielectric chip 30 is mounted on an insulating carrier substrate 35 which includes ground planes 33A, 33B, preferably disposed on the upper surface of insulating carrier substrate 35. Dielectric chip 30 has an obverse face on which a radiating element 31 is provided, and a reverse face which is substantially flush with the upper surface of carrier substrate 35. Dielectric chip 30 is positioned on carrier substrate 35 so as to be offset from ground planes 33A, 33B. A pair of lower metallic radiating elements 34A and 34B are provided on the reverse face of dielectric chip 30. Lower radiating element 34A is connected to upper radiating element 31 by conducting metal trace line 36A, similarly lower radiating element 34B is connected to upper radiating element 31 by conducting metal trace line 36B.

The antenna of FIG. 3 has a feed point on the reverse face and near an edge of dielectric chip 30 which is realized by a metal I/O pad 32 disposed on the reverse face of dielectric chip 30. I/O pad 32 is connected to upper radiating element 31 by a conducting metal trace 36C.

Electrical connection between a transceiver device (not shown) is made by a feed-line, which has two sections 37A and 37B. Section 37A of the feed-line is preferably a coplanar waveguide structure bounded on both sides by ground planes 33A and 33B; section 37B of the feed-line extends between and connects co-planar waveguide feed-line section 37A and metal I/O pad 32.

Figure 4:
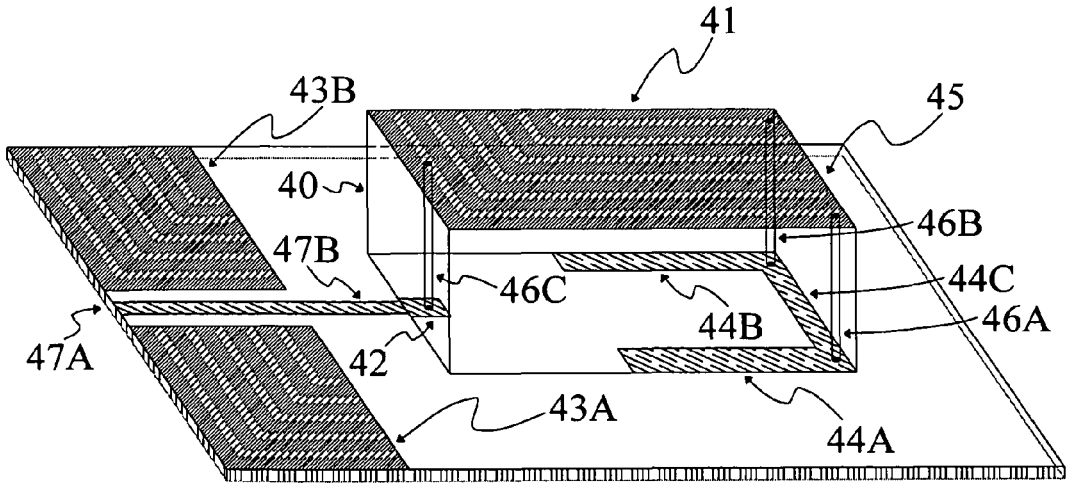
FIG. 4 is a perspective view of a further alternative two-tier chip antenna mounted on a substrate and embodying said second and third aspects of the present invention.

FIG. 4 shows a further alternative two-tier wideband chip antenna embodying said aspect of the invention. In this embodiment, the metal trace lines are replaced by conductive vias 46A, 46B, 46C. Otherwise, the antenna of FIG. 4 is substantially similar to the antenna of FIG. 2 and the same description applies as would be understood by a skilled person. The antenna of FIG. 4 comprises a chip 40 of a material with a dielectric constant which is greater than unity. Dielectric chip 40 is mounted on an insulating carrier substrate 45 which includes ground planes 43A, 43B, preferably disposed on the upper surface of insulating carrier substrate 45. Dielectric chip 40 has an obverse face on which a metallic radiating element 41 is provided, and a reverse face which is substantially flush with the upper surface of carrier substrate 45. Dielectric chip 40 is positioned on carrier substrate 45 so as to be offset from ground planes 43A, 43B. A lower metallic radiating element comprising side elements 44A and 44B and centre element 44C is provided on the reverse face of dielectric chip 40. Lower radiating structure side elements 44A and 44B are connected to upper radiating element 41 by conductive vias 46A and 46B respectively. The vias 46A, 46B take the form of through holes which penetrate dielectric chip 40 and are lined or filled with a conductive material, typically metal.

The antenna of FIG. 4 has a feed point on the reverse face and near an edge of dielectric chip 40 which is realized by a metal I/O pad 42 disposed on the reverse face of dielectric chip 40. I/O pad 42, is connected to upper radiating element 41 by a conducting metal plated or metal filled through hole 46C.

Electrical connection between a transceiver device (not shown) is made by a feed-line, which has two sections 47A and 47B. Section 47A of the feed-line is preferably a coplanar waveguide structure bounded on both sides by ground planes 43A and 43B; section 47B of the feed-line extends between and connects co-planar waveguide feed-line section 47A and I/O pad 42.

Figure 1:
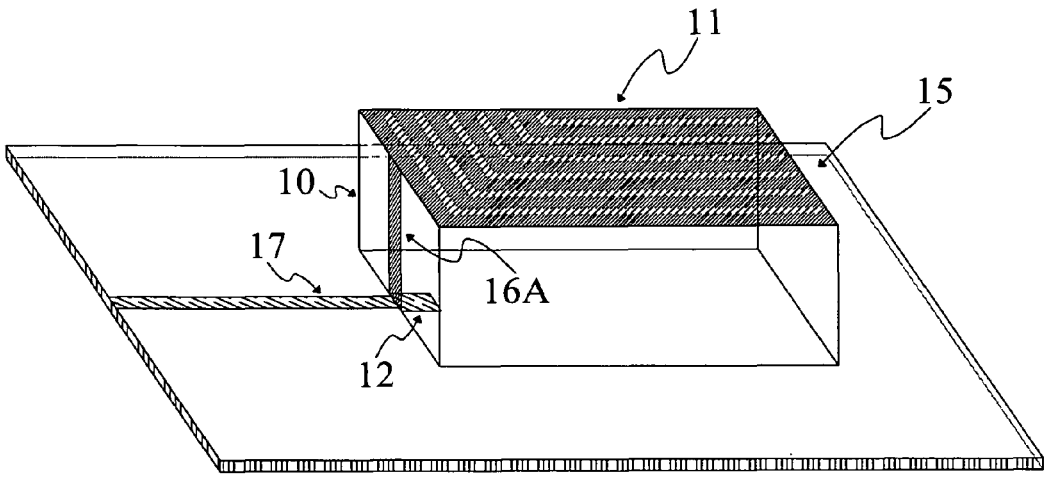
Fig. 1 (Prior Art)
FIG. 1 is a perspective view of a monopole chip antenna according to the existing art.
Figure 5:
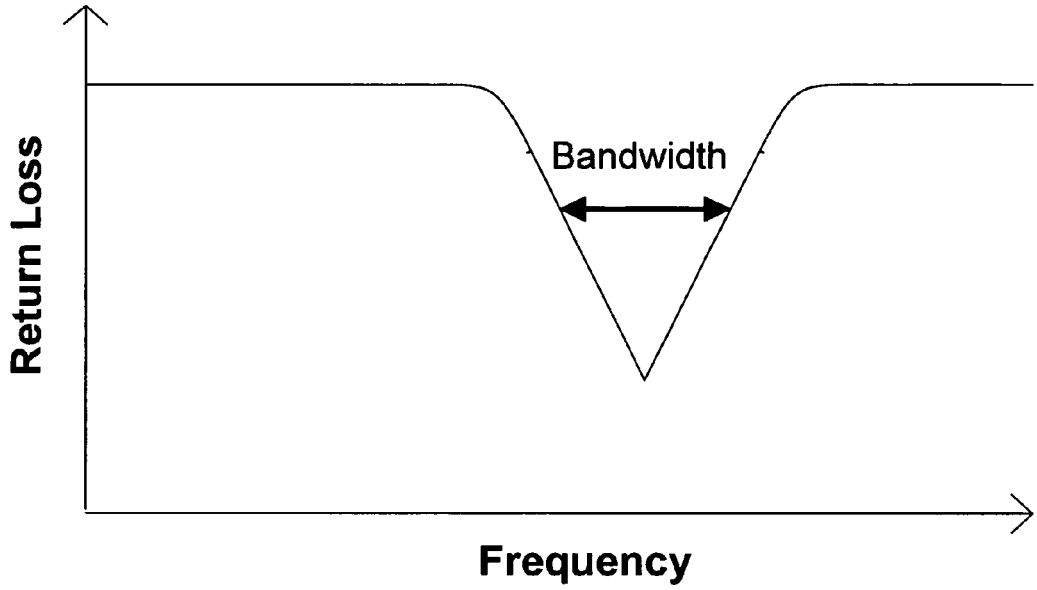
FIG. 5 shows a return loss frequency response of a monopole chip antenna.

FIG. 5 shows a return loss frequency response plot which is typical of the monopole chip antenna of FIG. 1. The antenna typically has a centre frequency determined by the physical dimensions of the radiating element 11, and the dielectric constant of the material forming dielectric chip 10. As a general guideline, the longest path from the input of the antenna at 12 to the furthest extremity will be in the order of one quarter of the wavelength of the centre frequency of operation. The bandwidth is determined by several factors including the ratio of X and Y (transverse and longitudinal) dimensions of the element 11, the material of the substrate, and the proximity of the radiating element 11 to its applicable ground plane.

Figure 6:
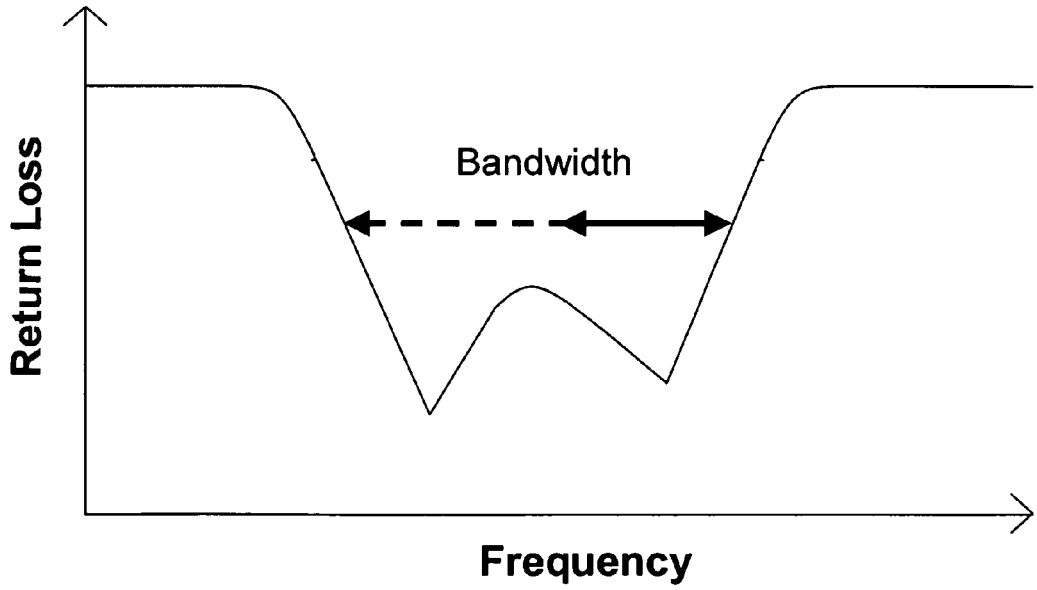
FIG. 6 shows an exemplary return loss frequency response of a two-tier chip antenna embodying said second aspect of the present invention.

FIG. 6 shows a return loss frequency response plot resulting from the two-tier wideband antenna of FIG. 2. The effect of lower radiating structure comprising side elements 24A and 24B and centre element 24C on the frequency response is to produce a second resonance at a lower frequency than that arising from upper resonating element 21. Consequently, the lower resonating element has two beneficial effects: the bandwidth of the antenna is extended; an effectively larger antenna is produced compared to a monopole chip antenna with the same physical dimensions of the antenna of FIG. 2.

Figure 7:
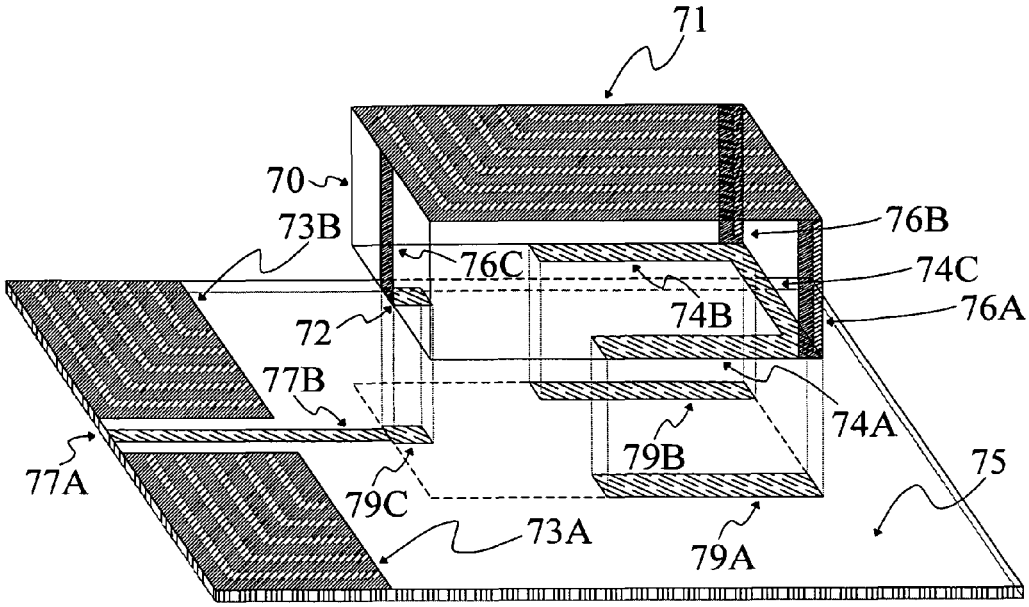
FIG. 7 is an exploded perspective view of the two-tier chip antenna of FIG. 2 and said substrate to which the antenna is attached in use.

FIG. 7 shows an exploded diagram of a two-tier chip antenna embodying said second aspect of the present invention and the carrier substrate to which the antenna is attached. The antenna depicted in FIG. 7 has all of the features of the antenna of FIG. 2, where the numerals which identify the features of the antenna of FIG. 2 correspond to those of FIG. 7 but incremented by 50. The dielectric chip 70 of the antenna of FIG. 7 is shown raised from carrier substrate 75 to reveal a landing pattern on the carrier substrate which comprises landing pads 79A, 79B and 79C, the pads being formed from a conductive material, typically metal.

Preferably, when dielectric chip 70 is mounted on carrier substrate 75, the lower radiating elements 74A and 74B are substantially aligned and engaged with landing metal pads 79A and 79B respectively. Similarly, I/O pad 72 will be substantially aligned and engaged with landing metal pad 79C.

Advantageously, the frequency response of the antenna can be tuned by selecting a shape and/or size of landing metal pads 79A and 79B. Specifically landing pads 79A and 79B can be widened or elongated so as to effect slight changes in the return loss frequency response of the antenna to suit a particular application. In particular, landing pads 79A, 79B may be made larger then, smaller than or substantially the same size as the elements 74A, 74B, and/or may take different shapes than the elements 74A, 74B.

Figure 8:
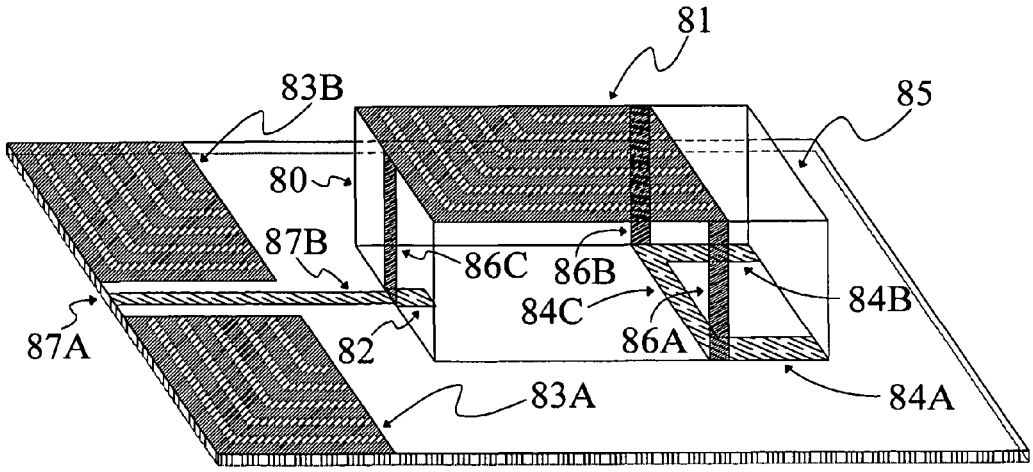
FIG. 8 shows a still further alternative two-tier chip antenna mounted on a substrate embodying said second and third aspect of the present invention.

FIG. 8 shows a further alternative two-tier wideband chip antenna embodying said second aspect of the invention. In this embodiment, the lower radiating elements 84A, 84B extend from their respective first end in a direction away from the other end of the first radiating element 81, i.e. generally away from the feed point 82. It is preferred that the lower radiating elements 84A, 84B, 84C is provided on the reverse face of the chip 80 and that the first radiating element 81 does not cover the entire obverse face of the chip 80 so that there is substantially no overlap of the upper and lower radiating structures (although some overlap may be present at the first ends of the side elements 84A, 84B and at the centre element 84C when present). Otherwise, the antenna of FIG. 8 is substantially similar to the antenna of FIG. 2 and the same description applies as would be understood by a skilled person. It will be understood that in alternative embodiments, the centre element 84C may be omitted, and/or the trace lines 86A, 86B, 86C may be replaced with vias, or other conductive connectors. Alternatively still, the radiating side elements 84A, 84B may extend beyond the chip 80, e.g. the chip 80 may be dimensioned to extend no further than the upper radiating element 81. By way of example, this may be achieved by fabricating lower radiating side elements 84A, 84B on the surface of a carrier substrate 85.

The antenna of FIG. 8 comprises a chip, 80 where the material of the chip has a dielectric constant that is greater than unity. Dielectric chip 80 is mounted on insulating carrier substrate 85 which includes ground planes 83A, 83B on the upper surface thereof. Dielectric chip 80 has an obverse face which is partially covered by metallic radiating element 81, and a reverse face which is substantially flush with the upper surface of carrier substrate 85. Dielectric chip 80 is positioned on carrier substrate 85 so as to be offset from ground planes 83A, 83B. A lower metallic radiating structure comprising elements 84A, 84B and 84C is provided on the reverse face of dielectric chip 80. Lower radiating structure elements 84A and 84B are connected to upper radiating element 81 by conducting metal trace lines 86A and 86B respectively.

The antenna of FIG. 8 has a metal I/O feed pad 82 disposed on the reverse face of dielectric chip 80. I/O pad 82, is connected to upper radiating element 81 by a conducting metal trace 86C. Electrical connection between a transceiver device (not shown) is made by a feed-line, comprising two sections 87A and 87B. Section 87A of the feed-line is preferably a coplanar waveguide structure bounded on both sides by ground planes 83A and 83B; section 87B of the feed-line extends between and connects co-planar waveguide feed-line section 87A and I/O pad 82.

For each of the antennas of FIGS. 2, 3, 4, and 8, a feed line comprising a section which has the structure of coplanar waveguide, 27A, 37A, 47A and 87A has been described; however alternative options for this section of the feed line include, a microstrip line, a grounded coplanar waveguide, a coaxial line, or a stripline.

Figures 10, 11:
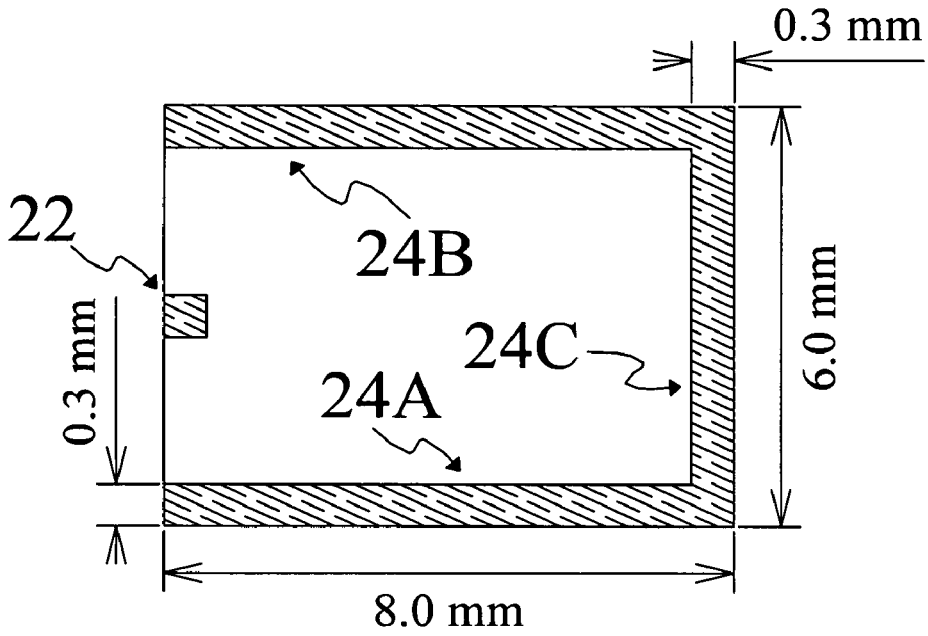
FIG. 10 shows a drawing giving the physical dimensions of second radiating structure comprising elements 24A, 24B and 24C used by way of example for the electromagnetic simulation of the antenna depicted in FIG. 2, the results of which are shown in FIG. 9*b;*
FIG. 11 is a table showing the frequency allocations of the UWB system as defined by the WiMedia Alliance.

Though the UWB system extends over a frequency range from 3.2 GHz to 10.6 GHz, it is generally divided into sub-bands according to the system in use. Table 1 of FIG. 11 shows the band allocations of the UWB system as defined by the WiMedia Alliance. The WiMedia alliance UWB system is divided into 5 separate band groups, where each band group is further divided into 3 bands (2 in the case of band group five) which are 528 MHz wide.

It will be noted that Band Group #2 of the UWB system presented in table 1 has a frequency range from 4752 to 6336 MHz. On the other hand, the 802.11a Wireless LAN system has a frequency range which can extend from 4910 to 5835 MHz—the frequency allocations vary from one region to another. Thus, the majority of UWB applications do not use the portion of the bandwidth between 5 and 6 GHz. Hence, good frequency characteristics of a UWB antenna are typically not required in Band Group #2; in fact, an antenna which has poor radiation efficiency within UWB Band Group #2 is more desirable than a similar antenna with good radiation efficiency in this band since the antenna with poor radiation efficiency will offer higher isolation of RF signals from the 802.11a system.

Figure 9A:
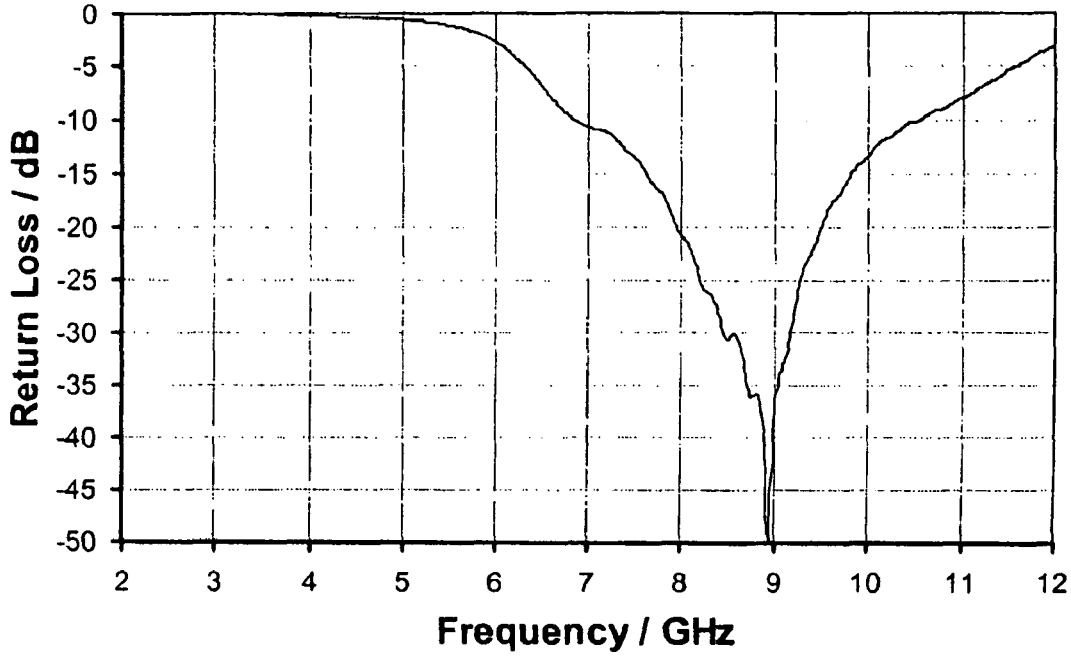
Fig. 9a (Prior Art)
FIG. 9*a* shows a return loss frequency response resulting from an electromagnetic simulation of the monopole patch antenna depicted in FIG. 1.

FIG. 9A shows a return loss frequency response resulting from an electromagnetic simulation carried out on the antenna depicted in FIG. 1 where the dimensions of the dielectric chip 10 are 8×6×1 mm and where the dielectric constant of the material of the dielectric chip 10 is 20.

Figure 9B:
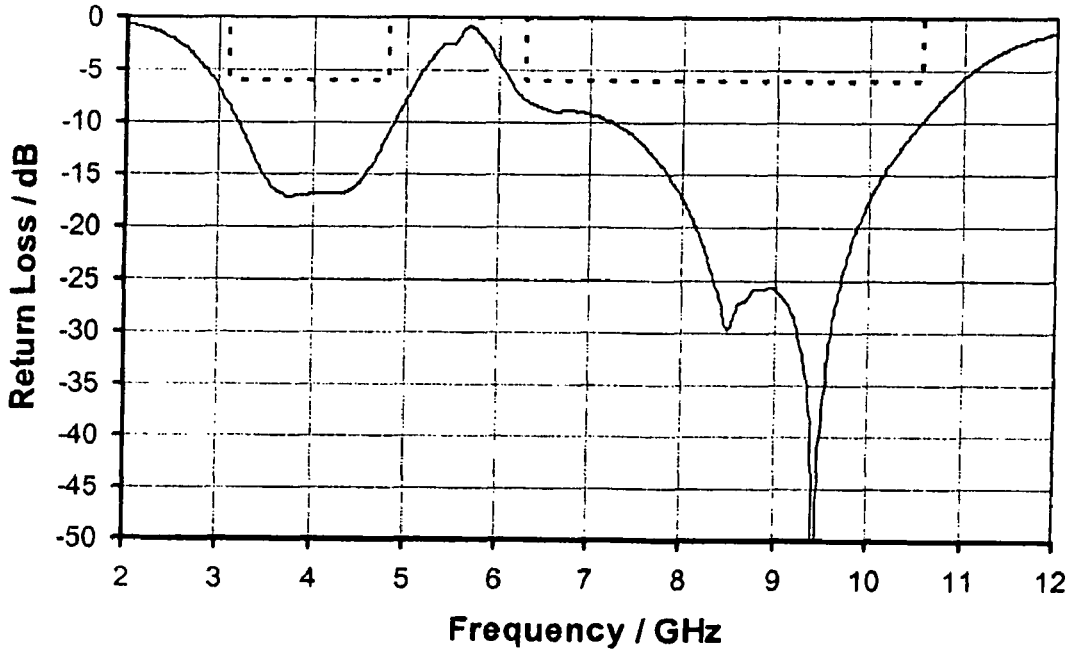
FIG. 9*b* shows a return loss frequency response resulting from an electromagnetic simulation of the two-tier wideband antenna depicted in FIG. 2.

FIG. 9B shows a return loss frequency response resulting from an electromagnetic simulation carried out on an antenna as depicted in FIG. 2, where, similar to FIG. 9A, the dimensions of the dielectric chip 20 are, by way of example, 8×6×1 mm and where the dielectric constant of the dielectric chip 20 is, for example, 20.

It can be seen from FIG. 9B that antennas embodying the second aspect of present invention advantageously have a wider band of operation when compared with the monopole patch antenna of similar dimensions such as that depicted in FIG. 1. For example, the lower edge of the return loss frequency response of the antenna of FIG. 2 has been shifted downwards in frequency by several GHz. The reduction in the frequency of the lower band edge of the frequency response of antennas embodying the present invention arises from the fact that several electrical paths are provided from the feed point to the furthest extremity of the antenna which are substantially longer than the longest electrical path of the monopole patch antenna of FIG. 1. Thus, the structure of the antenna comprising upper and lower resonating structures connected as described in the various embodiments above gives rise to the wider bandwidth of antennas embodying the present invention. Furthermore, since preferred embodiments of the present invention provide an antenna with a return loss frequency response having a lower band-edge which is several GHz lower in frequency than that of a similarly sized patch antenna, it is apparent that the antenna embodying the present invention provides a response which would typically require a structure of physically larger dimensions.

FIG. 10 shows a drawing giving an example of suitable physical dimensions of lower radiating structure comprising elements 24A 24B and 24C, as used for the electromagnetic simulation of the antenna depicted in FIG. 2, the results of which are shown in FIG. 9B.

It can be seen from FIG. 9B that the response of the antenna of FIG. 2 has the required characteristics for operation in the UWB system as defined by the WiMedia Alliance—for example, it can be seen that the return loss of the antenna is less than −6 dB over UWB band groups 1, 3, 4 and 5. It can also be seen from FIG. 9B that there is a zero in the response of the antenna in the frequency range between 5 GHz and 6 GHz, i.e. that the antenna of FIG. 2 is neither effective for receiving signals, nor for transmitting signals in the frequency range from 5 GHz to 6 GHz. This area of poor performance of the antenna coincides approximately with UWB band group 2—see FIG. 11. It is widely accepted in industry that any service offering data transfer using by the UWB system will not use UWB band group 2, since sections of UWB band group 2 have already been allocated to the 802.11a system. Therefore, the region of poor performance in the frequency response of the antenna of FIG. 2 does not impose a practical limitation on the use of the antenna for receiving and transmitting UWB signals according to the WiMedia Alliance. On the contrary, a poor response of the antenna over the frequency range of the 802.11a system is an acceptable characteristic, because it eases the specifications for RF filters required to block 802.11a signals from the UWB front-end.

Figure 12:
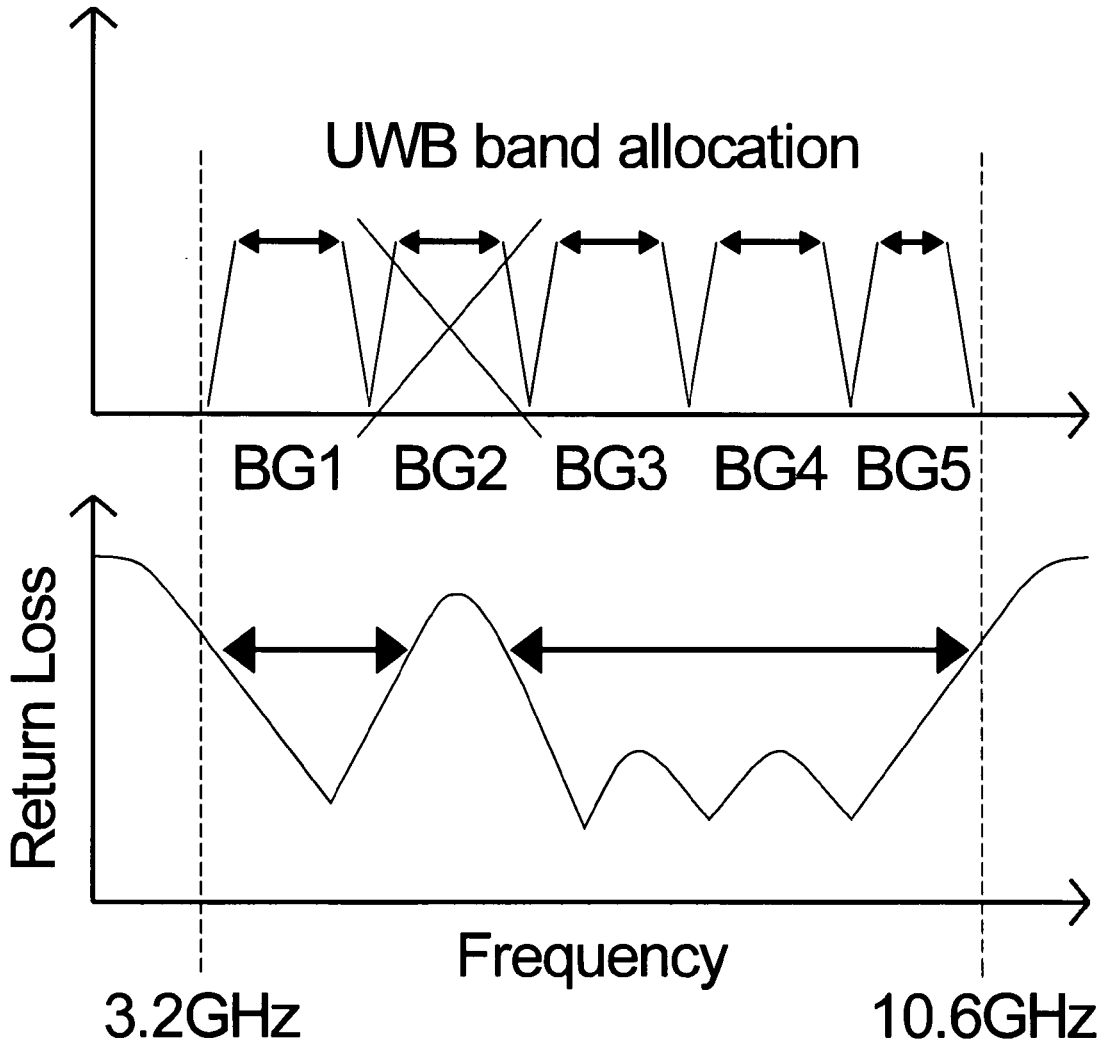
FIG. 12 shows the UWB band groups according to the WiMedia Alliance and the response of an ideal antenna for UWB.

FIG. 12 shows graphically the UWB band groups as defined by the WiMedia Alliance, and similarly shows the ideal antenna response for a wireless device which receives and transmits signals on the UWB system. Ideally the return loss of the antenna will be below a given threshold in UWB band group 1, and UWB band groups 3 to 6. Any zero in the response of the antenna should be located so that its centre is at the centre of UWB band group 2.

The response of the antenna of FIG. 2 depicted in FIG. 9B does generally fit the criteria for UWB operation as defined by the WiMedia alliance. However, preferably, the zero in the antenna response would fall at a slightly lower frequency, and hence an antenna which provides a mechanism for the tuning of the region of poor performance at the design stage would be highly advantageous.

Figure 13:
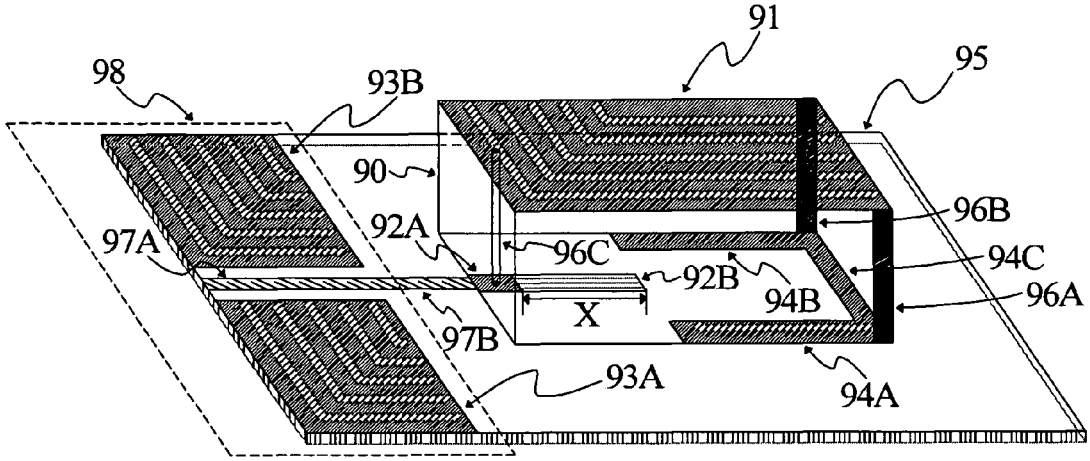
FIG. 13 shows a feedpoint tuned antenna embodying said first aspect of the present invention.

FIG. 13 shows an antenna embodying said first aspect of the present invention. The antenna of FIG. 13 is similar to the antennas of FIGS. 2 to 4 and the same description applies as would be apparent to a skilled person. The antenna of FIG. 13 comprises a block, or chip, 90 of electrically insulating material having a dielectric constant greater than unity, chip 90 being preferably rectangular in shape and being mounted on a carrier substrate 95 which includes an electrically conductive, typically metallic, feed-line 97B and ground planes 93A and 93B mounted on the surface thereof. Dielectric chip 90 comprises obverse and reverse faces which are substantially parallel to carrier substrate 95, and four side faces which are substantially perpendicular to carrier substrate 95. Dielectric chip 90 is mounted on carrier substrate 95 so as to be offset from ground planes 93A, 93B by a given distance. A first, or upper, electrically conductive, typically metallic, radiating structure 91 is fabricated on the obverse face of dielectric chip 90 and substantially covers the obverse face thereof and a second, or lower, electrically conductive, typically metallic, radiating structure comprising radiating elements 94A, 94B and 94C is fabricated on the reverse face of dielectric chip 90. The antenna of FIG. 13 has a feed point which is realized by an electrically conductive, typically metallic, I/O terminal, or pad, 92A disposed on the reverse face of dielectric chip 90 and adjacent to the perpendicular face of dielectric chip 90 nearest ground planes 93A and 93B. During use, RF signals are fed to and from the feed point of the antenna by feed line 97B and transmission line 97A which is preferably fabricated on the surface of carrier substrate 95 and which is preferably sandwiched between ground planes 93A and 93B so as to form a co-planar waveguide transmission line section 98. A corresponding landing pad (not shown) is fabricated on the surface of carrier substrate 95 and the antenna is fixed to the substrate (for example by soldering) so that I/O terminal 92A and the landing pad lie substantially in register. A via hole 96C filled, or lined, with electrically conductive material, typically metal, is formed in dielectric chip 90, and this electrically connects upper radiating structure 91 to I/O terminal 92A. Electrically conductive, typically metallic strips 96A and 96B are formed on perpendicular faces of dielectric chip 90 and are positioned so as to be near the perpendicular face of the chip furthest from ground planes 93A and 93B. Metallic strips 96A and 96B facilitate electrical connection between upper radiating structure 91 and the lower radiating structure comprising radiating elements 94A, 94B and 94C. An electrically conductive, typically metallic, stub 92B is fabricated on the reverse face of dielectric chip 90. Metallic stub 92B touches I/O terminal 92A and extends along the reverse face of dielectric chip 90 in a direction away from ground planes 93A and 93B by a distance X.

At the design stage, the distance X by which metallic stub 92B extends away from I/O terminal 92A is carefully selected to improve the electrical characteristics of the antenna.

In a second embodiment of the first aspect of the present invention (not shown), metallic stub 92B may fabricated on the surface of carrier substrate 95 so that it touches the landing pad which lies substantially in register with I/O terminal 92A.

Figure 14:
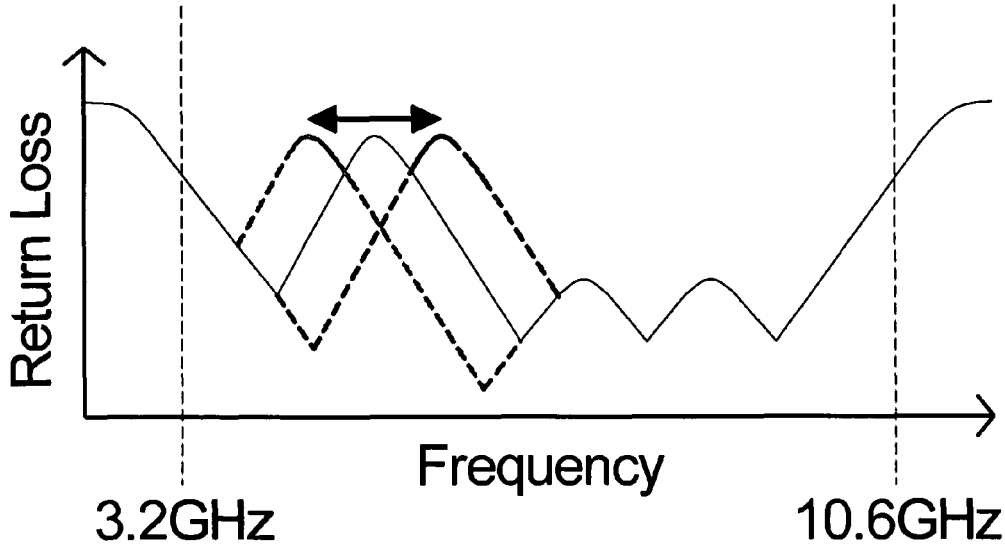
FIG. 14 shows the tuning of a zero in the frequency response of the antenna of FIG. 13 to improve the performance of the antenna.

FIG. 14 shows the effect of varying the distance X for the antenna of FIG. 13. The region of poor performance in the antenna response can be tuned up and down in frequency by adjusting the value of the distance X. This tunability of the antenna response enables the design of an antenna which has the optimum performance. For example, for an antenna designed to be used as a UWB antenna according to the system defined by the WiMedia Alliance, the antenna can provide low return loss over UWB band group 1, low return loss in UWB band groups 3, 4 and 5 and high return loss in UWB band group 2.

Figure 15:
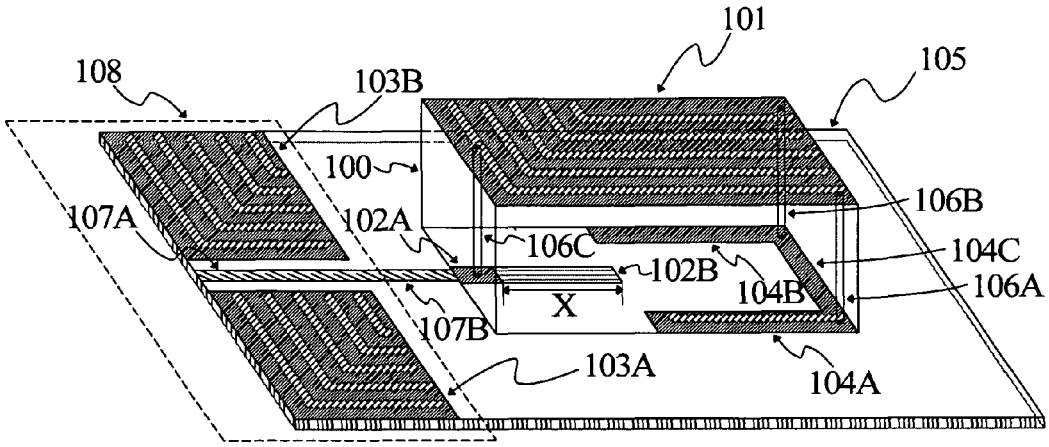
FIG. 15 shows an alternative feedpoint tuned antenna embodying said first aspect of the present invention.

FIG. 15 shows an alternative antenna embodying said first aspect of the present invention. The antenna of FIG. 15 is similar to the antennas of FIGS. 2 to 4 and the same description applies as would be apparent to a skilled person. The antenna of FIG. 15 comprises an insulating chip 100, where the material of the chip has a dielectric constant greater than unity, chip 100 being preferably rectangular in shape and being mounted on a carrier substrate 105 which includes metallic feed-line 107B and ground planes 103A and 103B mounted on the surface thereof. Dielectric chip 100 is positioned on carrier substrate 105 so as to be offset from ground planes 103A, 103B. Dielectric chip 100 comprises obverse and reverse faces which are substantially parallel to carrier substrate 105, and four faces which are substantially perpendicular to carrier substrate 105. An upper radiating structure 101 is fabricated on the obverse face of dielectric chip 100 and substantially covers the obverse face thereof and a lower radiating structure comprising radiating elements 104A, 104B and 104C is fabricated on the reverse face of dielectric chip 100. The antenna of FIG. 15 has a feed point which is realized by a metallic I/O terminal 102A disposed on the reverse face of dielectric chip 100 and adjacent to the perpendicular face of dielectric chip 100 nearest ground planes 103A and 103B. During use, RF signals are fed to and from the feed point of the antenna by feed line 107B and transmission line 107A which is preferably fabricated on the surface of carrier substrate 105 and which is preferably sandwiched between ground planes 103A and 103B so as to form a co-planar waveguide transmission line section 108. A corresponding landing pad (not shown) is fabricated on the surface of carrier substrate 105 and the antenna is fixed to the substrate (for example by soldering) so that I/O terminal 102A and the landing pad lie substantially in register. A metal filled, or lined, via hole 106C is formed in dielectric chip 100, and this connects upper radiating structure 101 to I/O terminal 102A. Electrically conducting via holes 106A and 106B are formed in dielectric chip 100 near the face furthest from ground planes 103A and 103B, and these via holes facilitate electrical connection between upper radiating structure 101 and the lower radiating structure comprising radiating elements 104A, 104B and 104C. An electrically conductive, typically metallic, stub 102B is fabricated on the reverse face of dielectric chip 100. Metallic stub 102B touches I/O terminal 102A and extends along the reverse face of dielectric chip 100 in a direction away from ground planes 103A and 103B by a distance X.

At the design stage, the distance X by which metallic stub 102B extends away from I/O terminal 102A is carefully selected to improve the electrical characteristics of the antenna.

Figure 16:
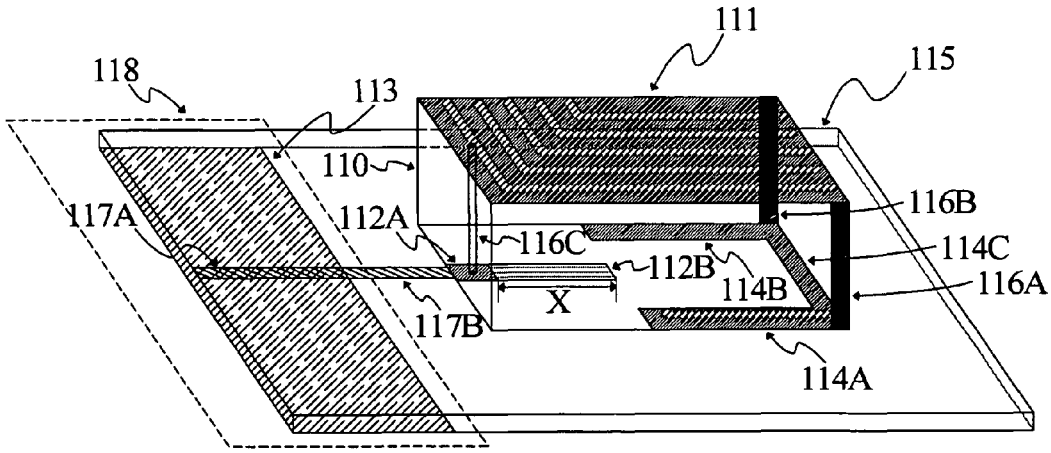
FIG. 16 shows a further alternative feedpoint tuned antenna embodying said first aspect of the present invention.

FIG. 16 shows a further alternative antenna embodying said first aspect of the present invention. The antenna of FIG. 16 is similar to the antennas of FIGS. 2 to 4 and the same description applies as would be apparent to a skilled person. The antenna comprises an insulating chip 110, of a material having a dielectric constant greater than unity. Dielectric chip 110 is preferably rectangular in shape and is mounted on a carrier substrate 115 which includes metallic feed-line 117B mounted on the surface thereof and ground plane 113 fabricated on the underside thereof. Dielectric chip 110 comprises obverse and reverse faces which are substantially parallel to carrier substrate 115, and four faces which are substantially perpendicular to carrier substrate 115. Dielectric chip 110 is mounted on carrier substrate 115 so as to be offset from ground plane 113 by a given distance. An upper radiating structure 111 is fabricated on the obverse face of dielectric chip 110 and substantially covers the obverse face thereof and a lower radiating structure comprising radiating elements 114A, 114B and 114C is fabricated on the reverse face of dielectric chip 110. The antenna of FIG. 16 has a feed point which is realized by a metallic I/O terminal 112A disposed on the reverse face of dielectric chip 110 and adjacent to the perpendicular face of dielectric chip 110 nearest ground plane 113. During use, RF signals are fed to and from the feed point of the antenna by feed line 117B and transmission line 117A which is preferably fabricated on the surface of carrier substrate 115 and which together with ground plane 113 preferably forms a microstrip transmission line section 118. A corresponding landing pad (not shown) is fabricated on the surface of carrier substrate 115 and the antenna is fixed to the substrate (for example by soldering) so that I/O terminal 112A and the landing pad lie substantially in register. A metal filled, or lined, via hole 116C is formed in dielectric chip 110, and this connects upper radiating structure 111 to I/O terminal 112A. Metallic strips 116A and 116B are formed on perpendicular faces of dielectric chip 110 and are positioned so as to be near the perpendicular face of the chip furthest from ground plane 113. Metallic strips 116A and 116B facilitate electrical connection between upper radiating structure 111 and the lower radiating structure comprising radiating elements 114A, 114B and 114C. An electrically conductive, typically metallic, stub 112B is fabricated on the reverse face of dielectric chip 110. Metallic stub 112B touches I/O terminal 112A and extends along the reverse face of dielectric chip 110 in a direction away from ground plane 113 by a distance X.

Figure 17:
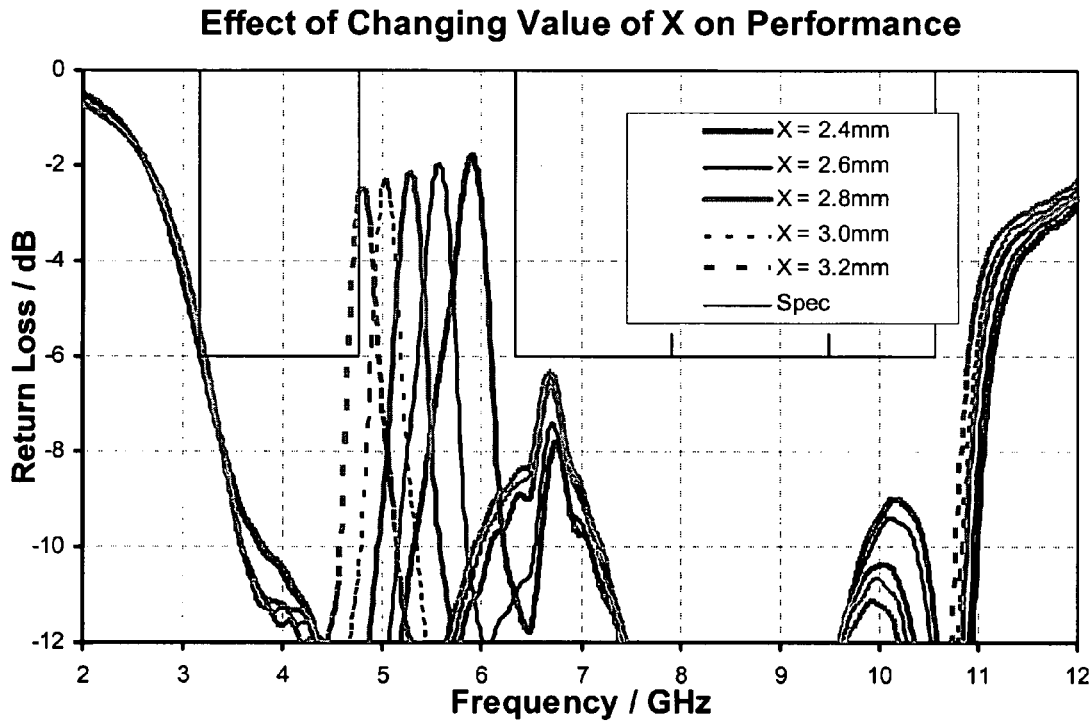
FIG. 17 shows a number of plots generated by 3D EM simulation which demonstrate the effects of varying the distance X for the antenna depicted in FIG. 13.

FIG. 17 shows a number of plots generated by 3D EM simulation which demonstrate the effects of varying the distance X for the antenna depicted in FIG. 13. For these simulations, the dimensions of the I/O terminal were 1.0 mm×1.0 mm. It can be seen that the effect of varying the distance X, is to tune the frequency at which a zero in the antenna response falls, and it can also be seen that there are no other significant effects on the performance of the antenna from changing the value of X. The response of the antenna is optimum when the value of X is equal to 2.6 mm.

It will be understood that the stub may be used with any of the antennas described herein.

The invention is not limited to the embodiments described herein which may be modified or varied without departing from the scope of the invention.

The invention claimed is:

1. An antenna comprising:

a first radiating structure located substantially in a first plane;

a second radiating structure electrically connected to said first radiating structure and located substantially in a second plane, said first plane being spaced apart from and substantially parallel to said second plane;

a feed point located substantially in said second plane and substantially in register with a first end of said first radiating structure, said feed point being electrically connected to said first radiating structure;

a block of dielectric material located substantially between said first radiating structure and second radiating structure and said feed point to provide a spacing between said first and second planes; and a stub comprising a length of transmission line having a first end electrically connected to said feed point and a second free end, said stub being located substantially in said second plane and extending in a direction from said feed point towards a second end of said first radiating structure, said second end being opposite said first end of said first radiating structure.

2. An antenna as claimed in claim 1, wherein said stub extends substantially parallel to a central axis of said first radiating structure.

3. An antenna as claimed in claim 2, wherein said stub is substantially in register with said central axis.

4. An antenna as claimed in claim 1, wherein said feed point is connected to said first radiating structure by an electrically conductive via that passes through said block of dielectric material.

5. An antenna as claimed in claim 1, wherein said first radiating structure is provided on an obverse face of said dielectric block, and said second radiating structure is provided on a reverse face of said dielectric block.

6. An antenna as claimed in claim 1, wherein at least one of said first and second radiating structures is embedded in said dielectric block.

7. An antenna as claimed in claim 1, wherein said second radiating structure comprises at least two spaced-apart, elongate radiating elements, each of said at least two radiating elements having a respective first end that is electrically connected to said first radiating structure substantially at said second end of said first radiating structure, said respective first end of said at least two radiating elements being substantially in register with said second end of said first radiating structure.

8. An antenna as claimed in claim 7, wherein said at least two radiating elements extend from their respective first end in a direction substantially towards said first end of said first radiating structure.

9. An antenna as claimed in claim 7, wherein said second radiating structure comprises a centre radiating element extending substantially perpendicularly between said at least two radiating elements.

10. An antenna as claimed in claim 9, wherein said centre radiating element is located substantially in register with said second end of said first radiating structure.

11. An antenna as claimed in claim 7, wherein said at least two radiating elements are substantially symmetrically arranged about a central axis running between said first and second ends of said first radiating structure.

12. An antenna as claimed in claim 7, wherein said first and second radiating structures are electrically connected by at least two spaced apart electrically conductive connectors.

13. An antenna as claimed in claim 12, wherein a respective electrically conductive connector connects a respective one of said at least two radiating elements to said first radiating structure, and wherein said respective electrically conductive connectors are located substantially at an end of a respective one of said at least two radiating elements.

14. An antenna as claimed in claim 13, wherein said respective electrically conductive connectors are provided on a common end face or a respective side face of said block of dielectric material.

15. An antenna as claimed in claim 12, wherein said respective electrically conductive connectors comprise a respective through hole formed in said block of dielectric material and lined or filled with an electrically conductive material.

16. An antenna as claimed in claim 1, wherein said first radiating structure comprises a substantially planar patch of electrically conductive material.

17. An antenna as claimed in claim 1, mounted on a substrate formed from an electrically insulating material such that said second radiating structure is substantially flush with an obverse face of said substrate, and wherein said substrate carries a signal feeding structure connected to said feed point.

18. An antenna as claimed in claim 17, wherein an electrically conductive input/output contact pad is provided on said obverse face of said substrate, the input/output contact pad being substantially in register with and connected to said feed point.

19. An antenna as claimed in claim 17, wherein a ground plane is provided on said obverse face of the substrate, spaced apart from said block of dielectric material.

20. An antenna as claimed in claim 19, wherein said ground plane comprises first and second adjacent portions spaced apart to define a gap therebetween, and wherein said signal feeding structure passes through said gap.

21. An antenna as claimed in claim 17, wherein a ground plane is provided on a reverse face of the substrate, spaced apart from said block of dielectric material.

22. An antenna as claimed in claim 1, wherein said antenna has a frequency response that includes a pass band, in which signals may be transmitted and/or received during use, and an attenuation band, in which said signals are relatively attenuated, occurring within said pass band, the arrangement being such that said attenuation band is centred about a frequency that is determined by the length of said stub.

23. An antenna comprising:

a first radiating structure located substantially in a first plane and having a feed point located substantially at a first end of said radiating structure;

a second radiating structure located substantially in a second plane, said first plane being spaced apart from and substantially parallel to said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first end of said at least two radiating elements being substantially in register with said second end of said first radiating structure, and wherein said feed point is located substantially in said second plane and substantially in register with said first end of said first radiating structure, said feed point being electrically connected to said first radiating structure, the antenna further including a stub comprising a length of transmission line having a first end electrically connected to said feed point and a second free end, said stub being located substantially in said second plane and extending in a direction from said feed point towards a second end of said first radiating structure, said second end being opposite said first end of said first radiating structure.

24. An antenna comprising a first radiating structure located substantially in a first plane; a second radiating structure electrically connected to said first radiating structure and located substantially in a second plane, said first plane being spaced apart from and substantially parallel to said second plane; a feed point located substantially in said second plane and substantially in register with a first end of said first radiating structure, said feed point being electrically connected to said first radiating structure; a block of dielectric material located substantially between said first radiating structure and second radiating structure and said feed point to provide a spacing between said first and second planes; and a stub comprising a length of transmission line having a first end electrically connected to said feed point and a second free end, said stub being located substantially in said second plane and extending in a direction from said feed point towards a second end of said first radiating structure, said second end being opposite said first end of said first radiating structure, wherein said antenna has a frequency response that includes a pass band, in which signals may be transmitted and/or received during use, and an attenuation band, in which said signals are relatively attenuated, occurring within said pass band, the arrangement being such that said attenuation band is centred about a frequency that is determined by the length of said stub.

* * * * *